United States Patent [19]

Bishop et al.

[11] Patent Number: 4,533,894

[45] Date of Patent: Aug. 6, 1985

[54] ADJUSTABLE BIMETAL SNAP DISC THERMOSTAT WITH HEATERS

[75] Inventors: Ralph L. Bishop; William N. Rich; Walter C. Kowalski, all of Mansfield, Ohio

[73] Assignee: Therm-O-Disc, Incorporated, Mansfield, Ohio

[21] Appl. No.: 621,665

[22] Filed: Jun. 18, 1984

[51] Int. Cl.[3] ..... H01H 61/02; H01H 37/52

[52] U.S. Cl. ..... 337/107; 337/102; 337/354; 337/377

[58] Field of Search ..... 337/107, 105, 104, 103, 337/102, 377, 354, 37

[56] References Cited

U.S. PATENT DOCUMENTS 3,248,501 4/1966 Hire ..... 337/37

3,870,985 3/1975 Hire ..... 337/377

4,037,316 7/1977 Stoll ..... 337/107

*Primary Examiner*—Harold Broome

*Attorney, Agent, or Firm*—Pearne, Gordon, Sessions, McCoy, Granger & Tilberry

[57] ABSTRACT

An adjustable bimetal snap disc thermostat is disclosed which provides conventional resistance-type heaters symmetrically positioned adjacent one side of the snap disc to allow adjustment of the operating temperature of the thermostat. The heaters are supported by heater terminals which extend up through the thermostat body and cover, and connect the cover to the thermostat body. The heaters and heater terminals are connected as a subassembly and subsequently installed as a unit in a device to minimize assembly costs. Further, since the heaters are conventional commercially available heaters, the cost of the heaters per se is minimized.

13 Claims, 8 Drawing Figures

ADJUSTABLE BIMETAL SNAP DISC THERMOSTAT WITH HEATERS

BACKGROUND OF THE INVENTION

This invention relates generally to bimetal snap disc thermostats, and more particularly to a novel and improved thermostat of such type in which resistance heaters are provided to permit adjustment of the operating temperature of the thermostat.

PRIOR ART

Bimetal snap disc thermostats which provide an electrical resistance heater controlled by an external control circuit to change the operating temperature of the thermostat are known. An example of such a thermostat is illustrated and described in U.S. Pat. No. 3,248,501 (assigned to the assignee of the present invention), which patent is incorporated herein by reference. Such device includes an annular disc-shaped heater of special construction which is positioned adjacent to the snap disc. Because the disc heater is not a standard available heating device of general utility, it is relatively expensive to produce. Further, when the disc heater is installed in the thermostat, it must be subsequently connected to the terminals. Consequently, the thermostat in accordance with such patent is relatively expensive to produce, and is also relatively expensive to assemble.

It is also known to provide strip heaters in combination with blade-type bimetal thermostats, as illustrated in U.S. Pat. No. 3,870,985. Here again, the heater is of a special construction, and therefore relatively expensive to produce.

SUMMARY OF THE INVENTION

In accordance with the present invention, a novel and improved adjustable snap disc thermostat provides a pair of standard resistance heaters symmetrically positioned adjacent to one side of a bimetal snap disc. Such resistance heaters are supported directly on terminals which extend up through the thermostat body and out through the cover member which covers the switch chamber. The heaters and terminals are structured for separate connections as a subassembly which is then installed as a unit during the assembly of the thermostat itself. Consequently, the installation of the heater does not require a secondary welding or soldering operation during the assembly of the device. Further, since the heaters and terminals are connected before assembly, full access is available when the connections are made and a good and uniform connection can be efficiently and economically produced. Also, since the subassembly of the heaters and terminals is installed at the unit, it is not necessary to separately install the parts of the subassembly. This further reduces manufacturing costs.

In the illustrated embodiment, the heaters are standard heaters which are mass-produced for the general market, and are available at low cost. Therefore, the cost of the heaters themselves is drastically reduced when compared to a heater which must be custom-manufactured, as illustrated in the prior art discussed above.

Further in the illustrated embodiment, the terminals for the heaters extend up through the body and through the cover member and function to securely position the cover member with respect to the body, thus eliminating the need for separate mechanical connections between the cover and the body.

These and other aspects of this invention are illustrated in the accompanying drawings, and are more fully described in the following specification.

DETAILED DESCRIPTION OF THE DRAWINGS

Figure 2:
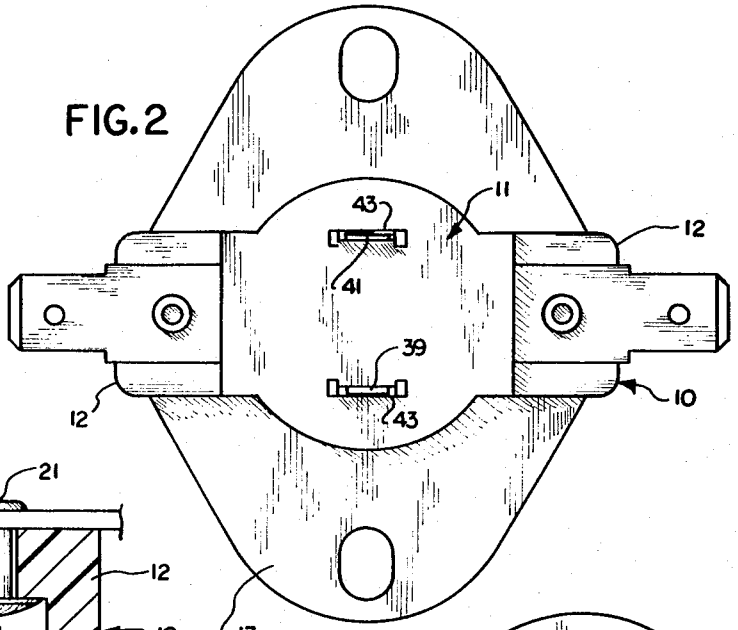
FIG. 2 is a plan view of the completed thermostat.
Figure 3:
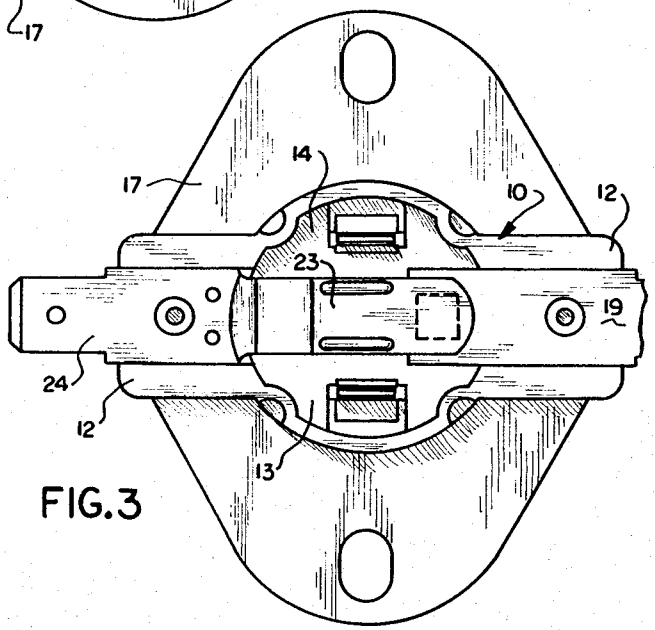
FIG. 3 is a plan view similar to FIG. 2, but illustrating the thermostat with the cover removed to expose the switch of the thermostat.

The illustrated embodiment of a thermostat in accordance with the present invention includes a body assembly consisting of a body member 10 and a cover 11, both of which are molded of a nonconducting, nonmetallic material such as a phenolic resin. The body member 10 is provided with a generally circular central portion and two terminal support extensions 12. The central portion is formed with two open ends separated by a central wall 13. The cover member 11 is mounted at one open end and cooperates with the body 10 to define a switch chamber 14. A bimetal snap disc 16 is mounted across the other open end of the body and is retained in position by a metallic disc cup 17. The bimetal snap disc is formed with a shallow curvature so that it has two positions of stability and snaps back and forth between such positions upon reaching predetermined temperatures determined by the form or dish shape of the bimetal forming the disc.

A switch is provided in the switch chamber 14 which includes a fixed or stationary contact 18 mounted on the inner end of a first switch terminal 19. Such first switch terminal 19 is secured to one of the terminal support extensions by a rivet 21. The switch also provides a movable contact 22 mounted on the end of a movable contact support arm 23 which is supported at its end on the other terminal support extension 12 and is connected to a second switch terminal 24 by a rivet 26. The movable contact support arm is formed of a spring material and is shaped to normally maintain the two contacts 18 and 22 in engagement so the switch is a normally closed switch.

The body is formed with a tubular bumper guide 27 providing a guide opening 28 through which a bumper 29 extends from a lower end 31 adjacent to the disc 16 and an upper end 32 adjacent to the movable contact support arm 23. The length of the bumper 29 is selected so that when the snap disc 16 is in its downwardly curved position illustrated in FIG. 1, the two contacts 18 and 22 are in engagement and the switch is closed. However, when the snap disc 16 snaps through to its upper position of curvature, the bumper 29 operates to open the contact with snap action. The bumper is sized to provide a small amount of lost motion (illustrated in FIG. 1 at the end 31) to ensure that the switch is actually opened and closed while the snap disc is in snap movement.

The disc 16 and the body 10 cooperate to define an annular heater chamber 33 open to one face of the disc 16 and extending around the bumper 29 and the tubular bumper guide 27. Positioned in the heater chamber 33 are a pair of heaters 34 and 36 arranged symmetrically on opposite sides of the bumper 29. Such heaters are generally cylindrical and provide leads extending from the opposite ends thereof. The heaters 34 and 36 are standard resistors which are mass-produced for the general market and are therefore inexpensive. The heaters may be, for example, solid ceramic core metal film resistors marketed by The Resistive Products Division of TRW Electronics Component Group of Boone, N.C. One satisfactory resistor that is marketed by that company has a TRW-type TO-55 (MIL type RN 55D) and has a TRW power rating of one-half a watt at 70° C.

Figure 4:
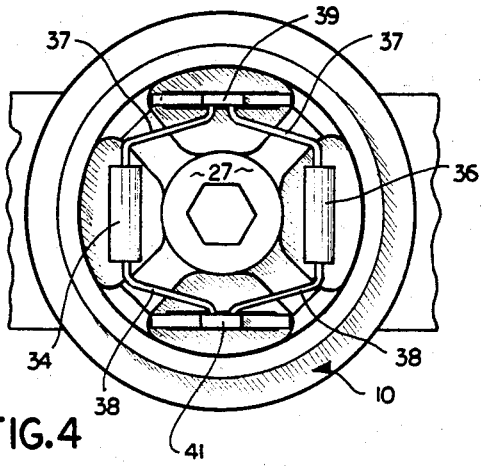
FIG. 4 is a bottom view with the disc and disc cap removed to illustrate the resistance heaters in their installed positions.
Figure 5:
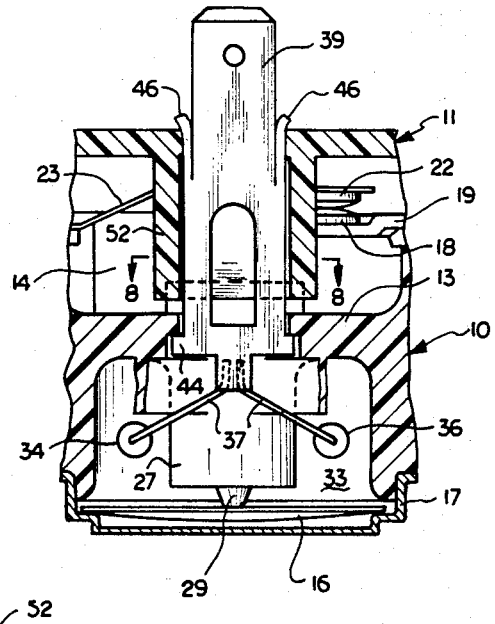
FIG. 5 is a broken section, taken generally along line 5—5 of FIG. 2, illustrating the structure and mounting of one of the heater terminals.

Referring to FIGS. 4 and 5, each of the heaters 34 and 36 is provided with two leads 37 and 38 extending from opposite ends thereof. The leads 37 of each of the heaters 34 and 36 are welded to a first heater terminal 39 and the leads 38 of each of the heaters 34 and 36 are welded at their ends to a second heater terminal 41. The two heater terminals 39 and 41 extend up through the body and through the cover 11 to provide external end portions for connection to an external control circuit.

In order to accommodate the terminals, the wall 13 of the body 10 is formed with openings 42 (illustrated in FIG. 6) sized to closely fit the edges of the associated terminals 39 and 41 to position the terminals within the thermostat. Similarly, the cover 11 is also formed with cover openings 43 aligned with the opening 42, again sized to closely fit the associated terminals 39 and 41. The inner end of each terminal is formed with a lateral extension 44 which seats against a mating surface of the body to position the inner end of each terminal with respect to the body in its proper installed position. Adjacent to the upper end of each terminal, the terminal provides staking projections 46 which are bent out against an upper surface of the cover 11 when the terminals are properly positioned, and such staking projections cooperate with the lateral projections 44 to longitudinally position each of the terminals within the body assembly.

Figure 1:
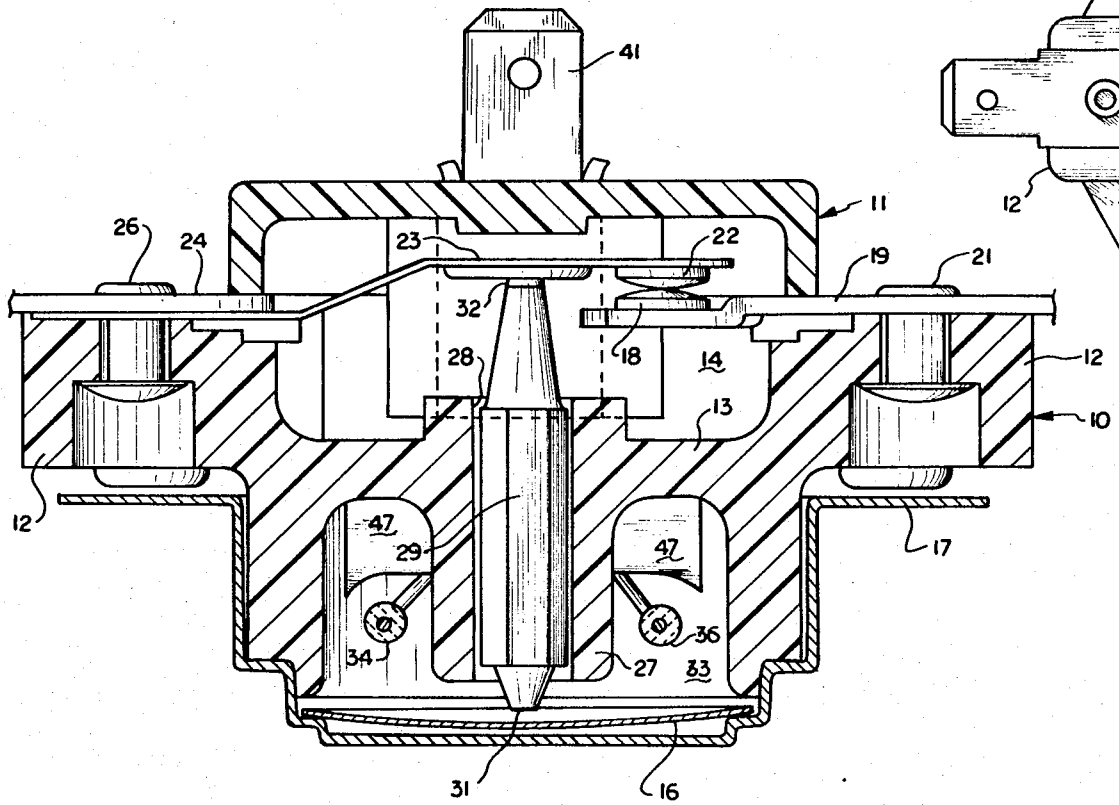
FIG. 1 is a vertical, centerline section through a preferred thermostat in accordance with the present invention.
Figure 6:
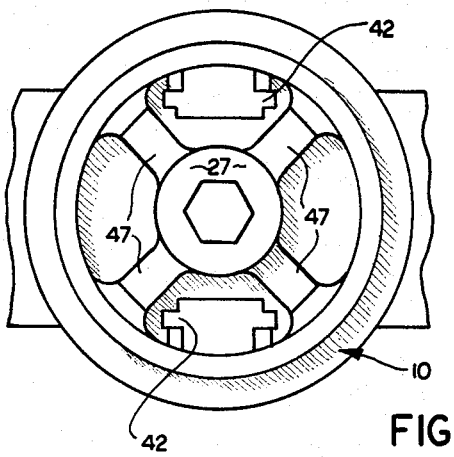
FIG. 6 is a bottom view of the body, with the heaters and heater terminals removed to better illustrate the body structure.

Referring to FIGS. 1 and 6, the body 10 is also provided with four radial webs 47 symmetrically positioned around the tubular bumper guide 27 and which extend from such bumper guide to the outer wall of the body to provide lateral support for the bumper guide and to also provide a surface against which the leads of the two heaters 34 and 36 are positioned to establish the spacing between the heaters and the disc in a uniform manner. The headers are preferably sized so that the heater bodies do not touch the body but are positioned by their leads 37 and 38 and by the terminals 39 and 41 within the heater chamber 33. When the heaters are so positioned, the heat generated is not directly conducted to the body 10 but, instead, operates to efficiently heat the chamber 33 and the disc 16. Further, the body is nonmetallic and has a much lower heat conductivity than the metal disc. Therefore, the body does not absorb heat rapidly and the disc temperature responds relatively quickly to heat produced by the heater.

The leads 37 and 38 are welded to their associated terminals 39 and 41 prior to the installation of the terminals and heaters in the thermostat. Because such welds are formed externally of the device, preferably within a positioning fixture, the welds can be economically and uniformly produced with high quality. Further, the position of the heaters with respect to the associated terminals is accurately determined at that time.

The heater and terminal subassembly is then installed as a unit within the body during the assembly of the entire device, and the terminals are staked in installed position. Consequently, the addition of the heaters to the device is easily accomplished with accuracy and economy. Additionally, the staking of the heater terminals against the cover 11 functions to provide a good mechanical mounting of the cover.

Usually, after the cover is secured to the body by means of the staking of the heater terminals 39 and 41, a sealant, such as an epoxy or the like, is applied along the joint between the cover and the body to completely seal the switch chambers 14. Because the heaters and heater terminals are installed through the disc end of the body, such installation of the heater terminal subassembly is completed before the installation of the disc 16 and the disc cup 17.

As mentioned previously, it is preferable to utilize a positioning fixture for the manufacture of the subassembly consisting of the heaters and the terminals so as to accurately position the heaters with respect to the terminals. Further, it is preferable to arrange such fixtures so that during installation of the subassembly the heater leads 37 and 38 engage the adjacent radial webs 47 before the terminals are fully seated so that the final small amount of movement of the terminals to their fully installed position occurs after the heater leads are properly seated against the webs. This small amount of additional movement of the terminal is accommodated by slight bending of the leads 37 and 38. With this arrangement, the spacing between the disc 16 and the heaters 34 and 36 is accurately maintained and the installation of the heater terminal subassembly is easily accomplished in an accurate manner with automated assembly equipment.

Figure 8:
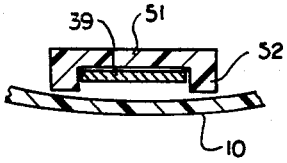
FIG. 8 is a fragmentary section taken along line 8—8 of FIG. 5.
Figure 7:
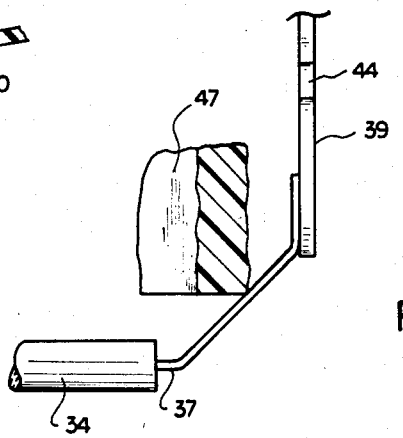
FIG. 7 is a fragmentary section illustrating the body structure for positioning the heaters.

Referring to FIGS. 5 and 8, the cover 10 is provided with two laterally spaced, U-shaped walls 51 which extend down along the inner sides of the heater terminals 39 and 41 between such terminals and the sides of the switch elements 18, 19, 22, and 23 to isolate the adjacent parts of the switch from the terminals to assure that the heater terminals are fully isolated from the switch and cannot short out during the use of the device. Such walls 51 provide lateral flanges 52 which extend past the edges of the heater terminals to completely isolate the heater terminals from the switch elements.

The heaters of the thermostat are connected to a suitable heater control circuit so that the thermostat operates at the desired temperature. For example, if the heaters are not energized, the environmental temperature around the disc cap is the source of heating or cooling of the disc 16 and the disc will operate at environmental temperatures determined by the curvature and material of the disc itself. However, when the heaters are energized, the disc temperature is determined by the heaters as well as the environmental temperature. The disc will continue to operate at the predetermined temperatures established by the disc curvature. However, because the disc is heated by the heaters as well as the environment, the disc will reach its operating temperature at a lower environmental temperature when the heaters are energized. Consequently, the temperature of the environment at which the disc operates is depressed by a function of the amount of heat produced by the heaters. With suitable controls to control the heat output of the heaters, the operating temperature of the thermostat can be adjusted from a location remote from the thermostat.

Because the heaters 34 and 36 are standard mass-produced heaters, the cost of the heaters is drastically reduced when compared to the prior art mentioned above. Further, since the heaters and heater terminals are connected as a subassembly externally of the thermostat, the assembly costs of the thermostat are not significantly increased by virtue of the provision of the heaters and the heater terminals. Further, since the heater terminal subassembly is installed in the thermostat as a unit and also functions to mechanically connect the cover 11 to the body, the assembly costs of the device are not significantly changed by the provisions of the heaters.

Although the preferred embodiment of this invention has been shown and described, it should be understood that various modifications and rearrangements of the parts may be resorted to without departing from the scope of the invention as disclosed and claimed herein.

What is claimed is:

1. A bimetal snap disc thermostat comprising a body assembly, a switch in said body assembly, a bimetal snap disc mounted on said body assembly, an operator operating said switch in response to snap movement of said bimetal disc, said disc and body assembly cooperating to define a heater chamber adjacent to said disc, a plurality of separate generally cylindrical resistance heaters symmetrically positioned in said heater chamber adjacent to said bimetal disc, and a pair of heater terminals mounted on said body assembly having inner ends in said heater chamber, said heaters providing leads extending from the ends thereof connected to said heater terminals, said heater terminals through said leads operating to position said heaters within said annular chamber.

2. A thermostat as set forth in claim 1, wherein said heaters are mass-produced general purpose resistors.

3. A thermostat as set forth in claim 2, wherein said heaters are ceramic core metal film resistors.

4. A thermostat as set forth in claim 3, wherein said body assembly provides lateral surfaces engaged by said heaters cooperating with said heater terminals to position said heaters with respect to said disc.

5. A thermostat as set forth in claim 4, wherein said lateral surface engages said leads, and said cylindrical part of said heaters is spaced from said body and said disc.

6. A thermostat as set forth in claim 5, wherein said body assembly includes a body member and a cover which cooperate to define a switch chamber enclosing said switch, said heater terminals extending through said body member and cover and operating to secure said cover on said body member.

7. A thermostat as set forth in claim 6, wherein said heater terminals extend through said switch chamber, and said body assembly includes a wall isolating said switch from said heater terminals.

8. A thermostat as set forth in claim 1, wherein said heaters and heater terminals are interconnected as a subassembly and are thereafter installed as a unit in said body assembly.

9. An adjustable thermostat comprising a body assembly, a movable temperature-responsive member mounted on said body assembly, a switch mounted on said body assembly operating in response to movement of said temperature-responsive member, a plurality of mass-produced general purpose resistance heaters providing a cylindrical heater portion with leads extending from the ends thereof mounted adjacent to said temperature-responsive member, said temperature-responsive member responding to the temperatures of the environment of said thermostat and heat produced by said heaters, operation of said heaters changing the environmental temperature at which said switch operates, and heater terminals connected to said leads and mounted in said body assembly positioning said heaters with respect to said temperature-responsive member, said heaters and heater terminals being connected as a subassembly and thereafter installed as a unit in said body assembly.

10. A thermostat as set forth in claim 9, wherein said temperature-responsive member is bimetal.

11. A thermostat as set forth in claim 10, wherein said body assembly includes a body member and a cover cooperating to define a switch chamber enclosing said switch, and said heater terminals connecting said body member and cover.

12. A thermostat as set forth in claim 11, wherein said heaters are ceramic core metal film resistance heaters.

13. A thermostat as set forth in claim 12, wherein said body assembly is formed of a material having substantially lower thermal conductivity than said temperature-responsive member, said body assembly and said thermally responsive member cooperating to define a heater chamber enclosing said heater, heat produced by said heater operating to heat said thermally responsive member more rapidly than said body assembly.

* * * * *